US005261973A

United States Patent [19]

Sienkowski et al.

[11] Patent Number: 5,261,973

[45] Date of Patent: Nov. 16, 1993

[54] ZINC PHOSPHATE CONVERSION COATING AND PROCESS

[75] Inventors: Michael L. Sienkowski, Warren; Gerald J. Cormier, Troy, both of Mich.

[73] Assignee: Henkel Corporation, Plymouth Meeting, Pa.

[21] Appl. No.: 736,835

[22] Filed: Jul. 29, 1991

[51] Int. Cl.[5] ..... C23C 22/86

[52] U.S. Cl. ..... 148/262

[58] Field of Search ..... 148/262

[56] References Cited

U.S. PATENT DOCUMENTS

| | | | |
|---|---|---|---|
| 2,298,280 | 10/1942 | Clifford et al. | 148/6.5 |
| 2,743,204 | 4/1956 | Russell | 148/6.5 |
| 4,389,260 | 6/1983 | Hauffe et al. | 148/6.15 Z |
| 4,486,241 | 12/1984 | Donofrio | 148/6.15 |
| 4,612,060 | 9/1986 | Kojima et al. | 148/6.15 Z |
| 4,793,867 | 12/1988 | Charles et al. | 148/6.15 Z |
| 4,838,957 | 6/1989 | Satoshi et al. | 148/260 |
| 4,865,653 | 9/1989 | Kramer | 204/38.1 |

FOREIGN PATENT DOCUMENTS

| | | |
|---|---|---|
| 0261597 | 3/1988 | European Pat. Off. . |
| 0287133 | 10/1988 | European Pat. Off. . |
| 0315059 | 5/1989 | European Pat. Off. . |
| 0370535 | 5/1990 | European Pat. Off. . |
| 2258463 | 8/1975 | France . |
| 1487866 | 10/1977 | United Kingdom . |
| 2204067 | 11/1988 | United Kingdom . |
| 2226829 | 7/1990 | United Kingdom . |

*Primary Examiner*—Sam Silverberg

*Attorney, Agent, or Firm*—Wayne C. Jaeschke; Patrick J. Span; Norvell E. Wisdom, Jr.

[57] ABSTRACT

Zinc phosphate coatings for metal surfaces and phosphating process. Concentrates containing (a) hydroxylamine sulfate and (b) zinc, nickel, manganese and phosphate ions are formulated into aqueous coating solutions for treating metal surfaces, including ferrous, zinc and aluminum surfaces.

2 Claims, No Drawings

ZINC PHOSPHATE CONVERSION COATING AND PROCESS

BACKGROUND OF THE INVENTION

1. Field of the Invention

This invention relates to zinc phosphate coatings for metal surfaces and a process for phosphatizing a metal surface with acidic aqueous phosphate solution. The invention is applicable to a variety of substrates including cold rolled steel (CRS), zinc alloys and aluminum.

2. Statement of Related Art

Present day phosphate coating solutions are dilute aqueous solution of phosphoric acid and other chemicals which, when applied to the surface of a metal react with the metal surface forming an integral layer on the surface of the metal of a substantially insoluble phosphate coating, amorphous or crystalline. Generally the crystalline coatings are preferred.

Typically the solutions include phosphate ions, zinc and other metal ions to provide specific characteristics desired in the final coating. Other ions typically present may be nitrate, nitrite, chlorate, fluoroborate or silicofluoride. A typical phosphating process is comprised of the following sequence:

(1) Cleaning and conditioning
(2) Phosphating and
(3) Post treating.

Rinses are generally employed between each step to prevent any carry over of materials to the next step.

Despite advances in both the composition of the phosphate coating solution and the phosphating process, there is a continued demand for still further improvements in the compositions and processes, to provide more control over the process, to form adequate coating weights, to reduce formation of scale or white spots, reduce environmental impact and safety concerns.

U.S. Pat. No. 4,838,957 describes a zinc phosphating process employing aqueous phosphate solution containing zinc ion, phosphate ion, manganese ion, fluoride ion and a phosphating accelerator. The accelerator may be one or more of (a) nitrate ion, (b) nitrite ion, (c) hydrogen peroxide, (d) m-nitrobenzene sulfonate ion, (e) m-nitrobenzoate ion or (f) p-nitrophenol. Nickel is indicated as an optional ingredient. While morphology of the coating is not discussed, the coatings are primarily a crystalline platelet structure.

In U.S. Pat. No. 4,865,653 phosphate coating solutions are described in which the accelerator employed is hydroxylamine sulfate (HAS) which is employed so as to alter the morphology of the resulting coating from platelet to a columnar and/or nodular structure over a broad range of zinc concentration. While Ni and Mn are generally mentioned as additional ions, there is no description of specific amounts of either in the patent or any specific examples thereof. The patent further describes a relatively large number of other patents which include hydroxylamine sulfate in zinc phosphate solutions, as well as various oxidizing agents including U.S. Pat. Nos. 2,743,204 and 2,298,280.

U.S. Pat. No. 4,793,867 describes a coating composition which includes zinc and another divalent cation, such as manganese or nickel in addition to a non-coating monovalent cation, such as sodium or potassium to provide improved alkaline solubility of conversion coatings applied to zinc-coated substrates. HAS is noted as eliminating any unwanted precipitation which may arise in adding any manganese alkali. Three U.S. Pat. Nos. 4,389,260; 4,486,241 and 4,612,060 are cited in the list of references cited in U.S. Pat. No. 4,793,867. These patents relate to zinc phosphating solutions which contain nickel and/or manganese.

DESCRIPTION OF THE INVENTION

In this description, except in the operating examples or where explicitly otherwise indicated, all numbers describing amounts of ingredients or reaction conditions are to be understood as modified by the word "about".

It has now been discovered that certain zinc phosphate compositions containing both nickel and manganese with hydroxylamine sulfate (HAS) as the accelerator, provide polycrystalline coatings and retain the advantages of the use of manganese and nickel, and the accelerator properties of the HAS without changing the platelet or needle like crystalline morphology, as described in U.S. Pat. No. 4,865,653 noted earlier above. The HAS accelerated zinc phosphating mixture of the present invention produces a desirable uniform, gray manganese and nickel modified zinc phosphate coating on a variety of substrates including ferrous alloys, zinc alloys and aluminum and its alloys at desirable temperatures in the range of about 100° to 150° F., preferably about 115° to 130° F., and can be applied by either spray or immersion applications. The hydroxylamine sulfate accelerator can be incorporated into the makeup and replenishing mixtures, when needed, without the need of traditional or supplemental undesirable accelerators, such as nitrite.

In addition to providing overall desirable advantages, without many of the disadvantages encountered in the art, the present invention provides for improved process uniformity at the low temperature, and reduces environmental impact and safety concerns associated with nitrite. The polycrystalline coating contains Zn, Mn and Ni in the coating, and Fe in coatings on ferrous surfaces.

The present invention deals with a make-up or concentrate composition, which may then be diluted with water to form an aqueous, acidic coating solution for a spray or immersion coating process. In general, the coating solution will contain concentrations by weight of

| | |
|---|---|
| $PO_4$ ion | 0.5–2.5% |
| Zn ion | 0.05–.2% |
| Ni ion | 0.02–0.15% |
| Mn ion | 0.02–0.15% |
| HAS | 0.1 to 0.25% |
| $NO_3$ ion | 0 to 0.2% |
| F ion | 0 to 0.15% |

The foregoing coating solution may be formed by diluting a concentrate containing the material providing the foregoing concentration when the concentrate is diluted with water in an amount of about 48 g/liter of concentrate. The concentrate is accordingly formulated to provide a coating solution containing from (a) from about 0.5 to about 2 g/l, preferably from about 0.8 to about 1.2 g/l of zinc ion;
(b) from about 5 to about 25 g/l, preferably from about 10 to about 15 g/l, or phosphate ion;
(c) from about 0.2 to about 1.5 g/l, preferably from about 0.5 to about 1 g/l of manganese ion;

(d) from about 0.2 to about 1.5 g/l, preferably 0.5 to about 1 g/l nickel ion;

(e) from about 1 to about 2.5 g/l, preferably 1.5 to about 1.75 g/l of hydroxylamine accelerator.

(f) 0 to about 1.5 g/l, of total fluoride ion with preferably a free fluoride content of about 400–600 parts per million;

(g) 0 to about 2 g/l nitrate ion.

In the phosphating solutions, it is preferable that the weight ratio of zinc ion to phosphate ion be 1: about 10 to 25, and the weight ratio of zinc to the sum of manganese and nickel 1:0.5 to 1.5, with the ratio of manganese to nickel being preferably about 1:1 with a ratio of 1:0.5 to 1.5 being satisfactory.

In the phosphating solution of the present invention, it is desirable for the solution to have a total acidity of about 15 to 25, preferably about 17–21, typically about 19–20 with a free acidity of about 0.5–1.0, more desirably about 0.6–0.9, and preferably about 0.7–0.8. Acidity herein is expressed in points, in which "points" as used herein is meant the mls of 0.1 NaOH required to titrate a 10 ml aliquot sample to a pH of 8.2, with phenolphthalein indicator for total acid and to a pH of 3.8 with bromophenol blue indicator for free acid.

Sources of the ingredients of the phosphating solutions of the invention include the following: as to the zinc ion: zinc oxide, zinc carbonate, zinc nitrate, etc.; as to the phosphate ion: phosphoric acid, zinc phosphate, zinc monohydrogen phosphate, zinc dihydrogen phosphate, manganese phosphate, manganese monohydrogen phosphate, manganese dihydrogen phosphate, etc.; as to the manganese ion: manganese oxide, manganese carbonate, manganese nitrate, the above manganese phosphate compounds, etc.; as to nickel ion: nickel oxide, nickel nitrate, nickel carbonate, etc.; as to the fluoride ion, hydrofluoric acid, fluoroboric acid, fluorosilicic acid, fluorotitanic acid, and their metal salts (e.g., zinc salt, nickel salt, etc., as to nitrate ion: nitric acid, nickel nitrate etc.

Hydroxylamine is the accelerator and in the present invention can be added to the concentrate before dilution to the coating solution. The hydroxylamine can be added in any suitable form and from any conventional source. The term "hydroxylamine agent", as used herein, means any compound that provides hydroxylamine or a derivative thereof such as a hydroxylamine salt or complex. Suitable examples include hydroxylamine phosphate, nitrate, sulfate, or mixtures thereof. More preferably, the hydroxylamine agent or source is hydroxylamine sulfate ("HAS"), a stable form of hydroxylamine.

As stated above, the metal surfaces treated in accordance with the present invention include iron-based surfaces, zinc-based surfaces, aluminum-based surfaces, and their respective alloy-based surfaces. These metal surfaces can be treated either separately or in combination. The advantage of the present invention is most prominently exhibited when the treatment is carried out on metal surfaces which include both an iron-based surface and a zinc-based surface, as, for example, in a car body.

It is conventional to perform other steps before and after the improved phosphating step of the present invention. Thus, it is advantageous to take steps to see that the part, workpiece or other article to be coated is substantially free of grease, dirt, or other extraneous matter. This is preferably done by employing conventional cleaning procedures and materials known to those skilled in the art. These would include, for example, mild or strong alkali cleaners, acidic cleaners, and the like. Such cleaners are generally followed and/or preceded by a water rinse.

It is highly preferred to employ a conditioning step following or as part of the cleaning step. These conditioning solutions which are known to the art typically employ condensed titanium compounds and preferably a condensed phosphate.

After the coating is formed by application of the compositions of the invention, the coated article is preferably rinsed with water and dried. The drying may be accomplished by simple ambient air drying but a forced air drying at elevated temperatures may be employed. In the coating step the temperature is preferably maintained at about 115° to about 130° F. although temperatures up to 150° F. are sometimes employed. At lower temperatures, longer time periods are typically required to achieve a uniform coating. The coating may be applied by immersion or spray techniques or a combination of each. Treatment times may vary from 30–180 seconds dependent on the temperature and technique of application.

Practical and preferred embodiments of the invention can be further illustrated by means of the following examples, which are not intended as limiting the invention, in which all parts and percentages are by weight unless otherwise indicated.

EXAMPLE 1

In this example a concentrate is prepared from the following materials in the amounts indicated.

| MATERIAL | PARTS BY WEIGHT |
|---|---|
| *Water | 368.5 |
| $H_3PO_4$ (75%) | 390.0 |
| $HNO_3$ (42° Be) | 5.0 |
| Hydroxylamine Sulfate | 35.0 |
| MnO | 13.5 |
| ZnO | 26.0 |
| $Ni(NO_3)_2$ (30% Solution) | 75.0 |
| $H_2SiF_6$ (25%) | 80.0 |
| HF (70%) | 7.0 |
| Total | 1000.0 |

Initially 331 parts of water, 37.5 added at end to make up 1000 parts total.

The concentrate when diluted to a 6% w/v in water has a free acid (FA) value of about 15 points and a total acid (TA) value of about 42 points. The ratio of Mn to Ni ion is 1:1, the ratio of Zn ion to the sum of Mn to Ni ion is 1:1, and the ratio of Zn ion to phosphate ion is 1:13.7.

EXAMPLE 2

In this example another concentrate is prepared from the following materials in the amounts indicated.

| MATERIAL | PARTS BY WEIGHT |
|---|---|
| *Water | 315.5 |
| $H_3PO_4$ (75%) | 390.0 |
| $HNO_3$ (42° Be) | 5.0 |
| Hydroxylamine Sulfate | 35.0 |
| MnO | 21.5 |
| ZnO | 26.0y |
| $Ni(NO_3)_2$ Solution (30%) | 120.0 |
| HF (70%) | 7.0 |
| $H_2SiF_6$ (25%) | 80.0 |

The concentrate when diluted with water to a 6% w/v in water has an FA of about 13.5 and a total TA of about 40. The ratio of Mn to Ni ion is 1:1, the ratio of Zn ion to the sum of Mn to Ni ion is 1:1.6, and the ratio of Zn ion to phosphate ion is 1:13.7.

EXAMPLE 3

This example will serve to illustrate the phosphating coating process employing the spray technique using the concentrate of Example 1. The concentrate was diluted with water to a concentration of 48 grams of concentrate per liter of coating solution and NaOH added to reduce the free acid level of the coating solution to 0.7 points and a total acid to 20.

In the typical procedure, after degreasing and cleaning of 4 inch by 6 inch metal panels with a commercial alkaline cleaner (Parcolene 1500C), followed by water rinse, the panels were conditioned with a commercial titanium salt (Fixodine Z8). The panels were then treated with the phosphate coating solution formed from the concentrate of Example 1 as noted above. After the phosphating treatment, the panels were water rinsed at ambient temperature using a 30 second water spray rinse followed by a 30 second deionized water spray rinse. The panels were then forced air dried at ambient temperature.

The results of the phosphating coating at a temperature of 115° F. and a 120 second spray time are as shown in Table 1 below with several runs on both cold rolled steel (CRS) and hot dipped galvanized (HDG).

TABLE 1

| SAMPLE | COATING WEIGHT (mg/ft²) CRS | HDG |
|---|---|---|
| A | 168 | 189 |
| B | 150 | 180 |
| C | 159 | 180 |
| D | 120 | 153 |
| E | 120 | 147 |
| F | 156 | 159 |
| G | 120 | 138 |
| H | 129 | 162 |
| I | 120 | 168 |
| J | 156 | 168 |
| K | 129 | 159 |
| L | 156 | 141 |
| M | 156 | 168 |
| N | 126 | 159 |
| O | 162 | 171 |
| P | 149 | 148 |
| Q | 121 | 156 |
| R | 117 | 153 |
| S | 121 | 151 |
| T | 136 | 156 |
| U | 120 | 145 |

The coatings were crystalline, platelet or needle-like, structure with a crystal size in the range of 3-15 microns for the CRS and 2-10 microns for the HDG. Other samples were run at different spray times and temperatures, and visual observation of the coatings indicated that satisfactory coatings may be obtained at temperatures as low as 105° F., but higher temperatures are preferred.

EXAMPLE 4

A series of aluminum 4 inch by 6 inch panels, 2036 Al and 5052 Al, were processed in the same manner as the CRS and HDG in Example 3, except that a potassium fluoride additive (8.6% free F ion, and 8.99% K ion) was employed to achieve a free fluoride level of 500-600 parts per million. Temperatures between 115°-130° F. were acceptable although a 120 second time was required at the lower temperatures. The panels exhibited coating weights ranging from 122-173 mg/ftz for the aluminum 2036 alloy and 150-195 mg/ft² for the aluminum 5052 alloy. Crystal size varied from 5 to 30 microns for both alloys.

EXAMPLE 5

In this example, several different substrates were treated for a 60 second spray following the procedure of Example 3. In addition to the aluminum alloys and the cold rolled steel (CRS), two different electrogalvanized (EG) substrates, and zinc-nickel alloy and AOI (zinc-iron alloy) are shown in the results of Table 2 below.

TABLE 2

| SUB-STRATE | CT. WT. (mg/ft²) | CRYSTAL SIZE (MICRONS) | VISUAL APPEAR-ANCE | BATH TEMPERA-TURE (°F.) |
|---|---|---|---|---|
| CRS | 127 | 3-12 | GOOD | 120 |
| 90E EG | 180 | 2-8 | GOOD | 120 |
| NAT. | 280 | 2-8 | GOOD | 120 |
| 70/70 EG Zn-Ni | 164 | 3-10 | GOOD | 120 |
| AOI | 183 | 3-10 | GOOD | 120 |
| 2036 AL | 179 | 5-20 | GOOD | 130 |
| 5052 AL | 195 | 5-18 | GOOD | 130 |

EXAMPLE 6

In this example, the concentrate of Example 2 was employed and instead of the spray application in Example 3, the metal panels were immersed in a bath of the coating solution, which was again formed by diluting the concentrate to 48 g/l, as was done in Example 3. The results on various substrate panels (4 in.×6 in.) with a 2 minute immersion time at a temperature of 115° F. are shown in the following Table 3, which also illustrates the coating composition analysis.

TABLE 3

| SUBSTRATE | COATING WEIGHT mg/ft² | Zn | Ni | Mn | $PO_4$ | Fe |
|---|---|---|---|---|---|---|
| CRS | 177 | 27 | 1.3 | 2.9 | 38 | 9.5 |
| EG | 185.1 | 37.5 | 1.3 | 4.3 | 38 | 0.16 |
| HDG | 168.6 | 37 | 1.8 | 4.5 | 38.9 | 0.14 |
| AL 2036 | 168.6 | 29.9 | 2.2 | 6.7 | 42.5 | 0.32 |

In general, the crystal size was 1-5 microns for all substrates. Also as in Example 3, bath temperatures above 105° F. are preferred, such as about 115°-135° F., with time periods above 60 seconds, and preferably above 80 seconds, being most preferred.

In all cases, the presence of the hydroxylamine sulfate did not change the morphology from a needle-like or nodular structure, but retained the morphology associated with the application method and substrate, as well as the presence of the manganese, in addition to the nickel, in the amounts described and in the ratios with the other components such as the zinc and phosphate ions in the coating solution and the amount of the hydroxylamine employed. The coatings in the invention are accordingly of either the platelet or nodular (in the case of immersion coating of CRS) crystalline structure providing excellent coating weights in a low temperature application either by spray or immersion techniques. The hydroxylamine accelerator may be added to the concentrate itself, avoiding the necessity of adding it when the coating solution is being later formulated from the concentrate. The coating solution requires no nitrite ion as an accelerator, thereby reducing environmental impact and safety concerns associated with nitrites.

The preferred compositions will provide a coating solution for either spray or immersion, of the following ingredients and ions in the amounts typically about those set forth below:

| Ingredient | % by Weight |
|---|---|
| Hydroxylamine Sulfate | 0.168 |
| Zinc ion | 0.10 |
| Nickel ion | 0.05 |
| Manganese ion | 0.05 |
| Phosphate ion | 1.37 |
| Nitrate ion | 0.12 |
| Complex fluoride | 0.074 |
| Free fluoride | 0.022 |

In the foregoing, the zinc to phosphate ratio is 1:13.7; the ratio of zinc to the sum of manganese and nickel of 1:1. With such composition, phosphate coatings can be satisfactorily formed in desirable coating weights not only on ferrous substrate such as cold rolled steel, including galvanized substrates but also on aluminum substrates.

As a practical matter, in coating operations, the coating solution may need to be replenished to maintain the appropriate levels of the materials in the coating solution and to maintain the acidity levels. Replenishing compositions will contain the various materials and ions in amounts effective, upon addition to the coating solution, to maintain the ions at the appropriate levels for coating and will contain ammonium carbonate or bicarbonate, and preferably ammonium hydroxide, in an amount effective, upon addition of the replenisher to the coating solution, to maintain the acidity level of the coating solution.

An example of a replenishing composition for the coating solutions of the present invention is:

| | |
|---|---|
| *Water | 270.2 |
| $H_3PO_4$ (75%) | 378.0 |
| Hydroxylamine Sulfate | 100.0 |
| MnO | 12.8 |
| ZnO | 68.0 |
| $Ni(NO_3)_2$ Solution (30%) | 60.0 |
| HF (70%) | 2.5 |
| $H_2SiF_6$ (25%) | 50.0 |
| Ammonium Hydroxide (26° Be) | 58.5 |

What is claimed is:

1. A concentrate composition for use in formulating an aqueous coating solution for the treatment of metal surfaces, said concentrate composition being selected from the group consisting of

| | Parts by Weight |
|---|---|
| (A) | |
| Water | about 368.5 |
| $H_3PO_4$ (75%) | about 390.00 |
| $HNO_3$ (42°Be) | about 5.0 |
| Hydroxylamine Sulfate | about 35.0 |
| MnO | about 13.5 |
| ZnO | about 26.0 |
| $Ni(NO_3)_2$ (30% solution) | about 75.0 |
| $H_2SiF_6$ (25%) | about 80.0 |
| HF (70%) | about 7.0 |
| and | |
| (B) | |
| Water | about 315.5 |
| $H_3PO_4$ (75%) | about 390.0 |
| $HNO_3$ (42°Be) | about 5.0 |
| Hydroxylamine Sulfate | about 35.0 |
| MnO | about 21.5 |
| ZnO | about 26.0 |
| $Ni(NO_3)_2$ (30% Solution) | about 120.0 |
| HF (70%) | about 7.0 |
| $H_2SiF_6$ (25%) | about 80.0. |

2. An aqueous phosphate coating solution for producing crystalline coatings on a metal substrate comprising the composition by weight of

| | % |
|---|---|
| hydroxylamine sulfate | about 0.168 |
| zinc ion | about 0.10 |
| nickel ion | about 0.05 |
| manganese ion | about 0.05 |
| phosphate ion | about 1.37 |
| nitrate ion | about 0.12 |
| free fluoride | about 0.022 |
| complex fluoride | about 0.074. |

* * * * *